US005868527A

United States Patent [19]

King et al.

[11] Patent Number: 5,868,527

[45] Date of Patent: Feb. 9, 1999

[54] MINE PROPS

[75] Inventors: Richard George King, Krugersdorp; Brian Peter Lewis, Roodepoort, both of South Africa

[73] Assignee: HL & H Timber Products (Proprietary) Limited, Parktown, South Africa

[21] Appl. No.: 848,730

[22] Filed: May 22, 1997

[30] Foreign Application Priority Data

May 22, 1996 [ZA] South Africa ..... 96/4086

[51] Int. Cl.[6] ..... E21D 15/00

[52] U.S. Cl. ..... 405/290; 405/288; 248/351

[58] Field of Search ..... 405/288, 290, 405/298; 248/351, 354.6

[56] References Cited

U.S. PATENT DOCUMENTS 1,622,038 3/1927 Lampert ..... 248/351
4,052,029 10/1977 Townsend ..... 405/288
4,712,947 12/1987 Thom ..... 405/288

FOREIGN PATENT DOCUMENTS 2 099 040 12/1982 United Kingdom ..... 405/290

*Primary Examiner*—Thomas B. Will
*Assistant Examiner*—Gary S. Hartmann
*Attorney, Agent, or Firm*—Oblon, Spivak, McClelland, Maier & Neustadt, P.C.

[57] ABSTRACT

The invention concerns a mine prop which has a cutting device and a cuttable plunger. The cutting device has a sleeve and a cutter which is fixed to the sleeve and which presents cutting edges transverse to the sleeve axis and axially oriented openings between the cutting edges. A vacant space exists in the sleeve beyond the cutting means. The cuttable plunger projects from the sleeve with at least a portion of the plunger extending within the sleeve to the cutter. When compressive loading applied to the mine prop is of sufficient magnitude to cause the cutting device and plunger to telescope together, the cutting edges of the cutting means cut axially through the cuttable plunger. The resulting segments of the plunger pass through the openings into the vacant space where they are restrained within the sleeve.

13 Claims, 3 Drawing Sheets

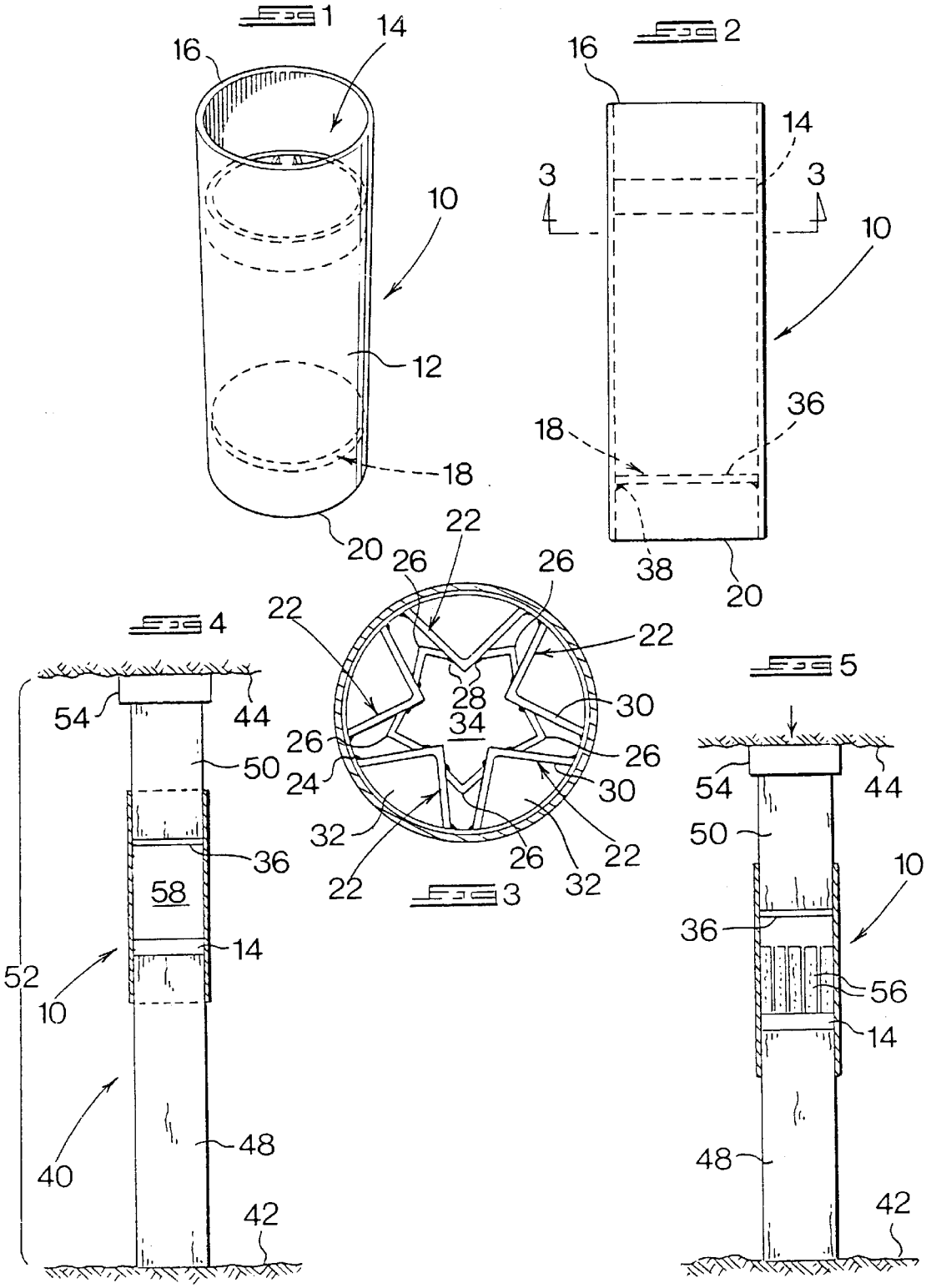
1
14
16
10
12
18
20
2
16
14
3
3
10
36
18
38
20
22
26
26
22
22
28
34
30
26
26
24
30
32
26
22
22
32
3
4
54
44
50
36
58
14
52
10
40
48
42
5
54
44
50
10
36
56
14
48
42

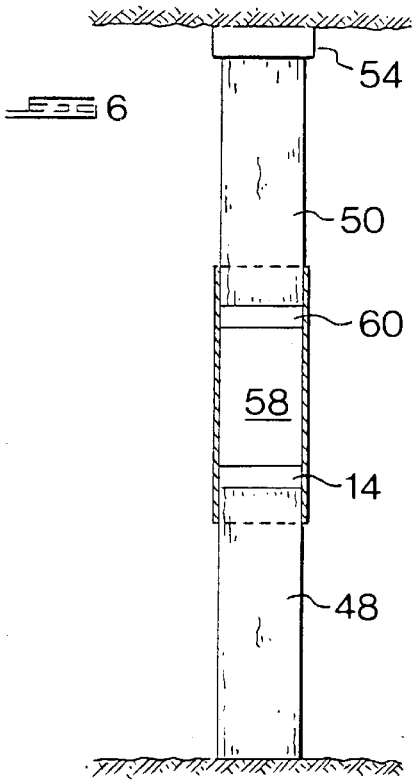
6
54
50
60
58
14
48
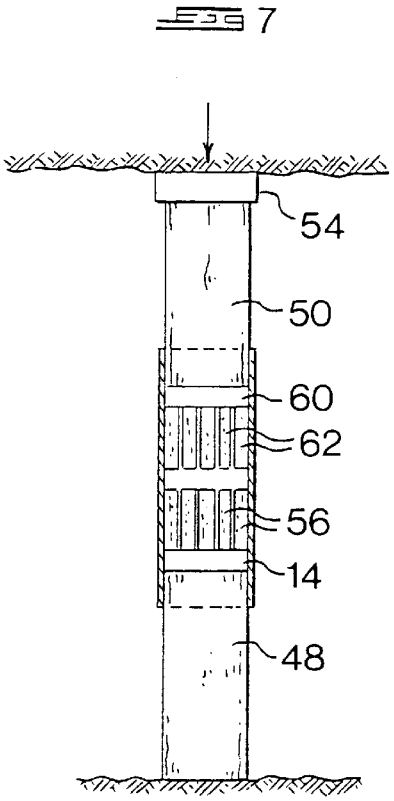
7
54
50
60
62
56
14
48
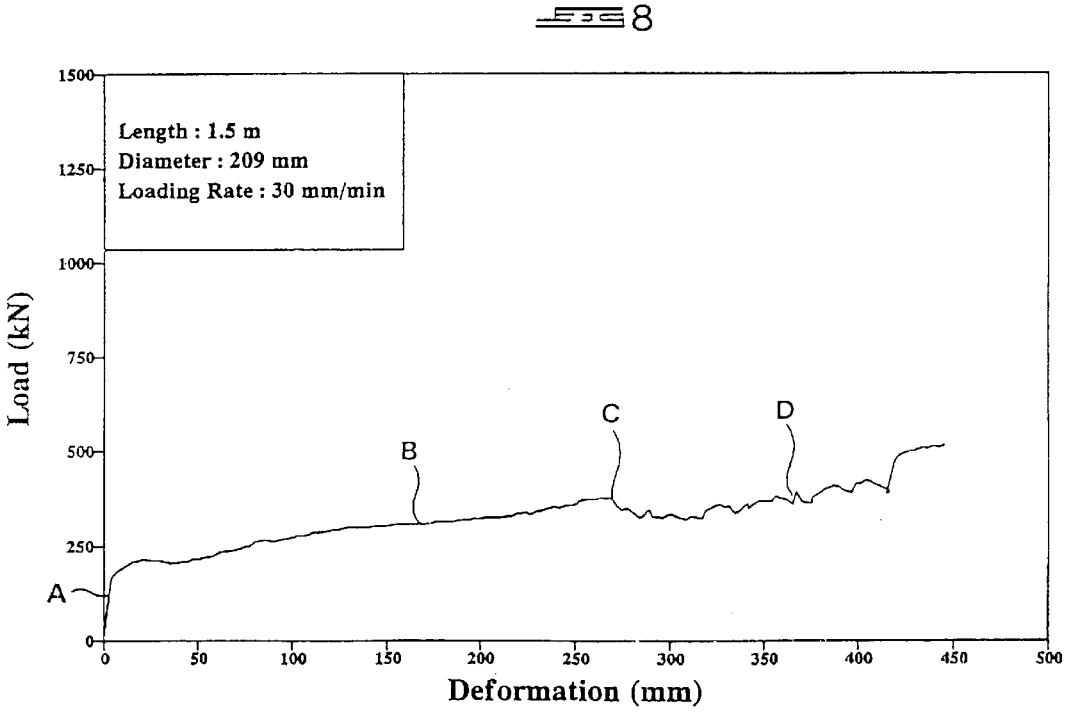
8
Length : 1.5 m
Diameter : 209 mm
Loading Rate : 30 mm/min
Load (kN)
Deformation (mm)
A
B
C
D
0
250
500
750
1000
1250
1500
0
50
100
150
200
250
300
350
400
450
500

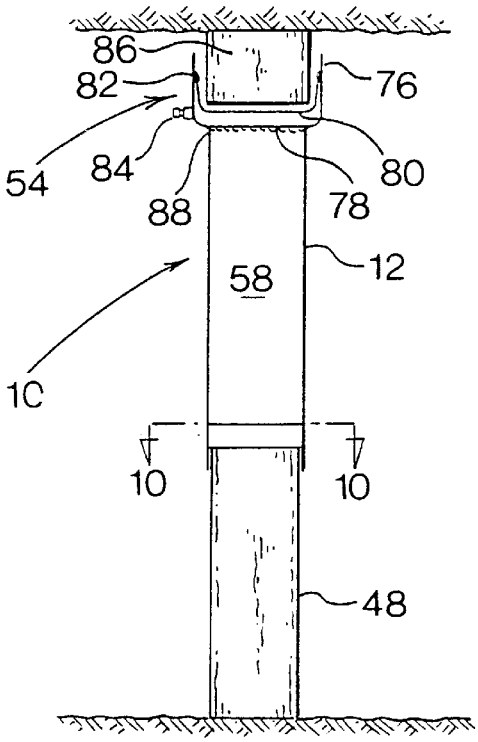
9
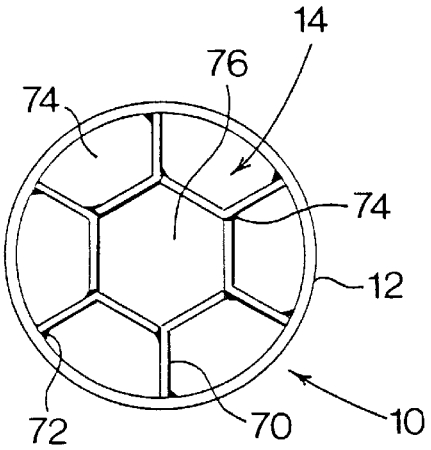
10
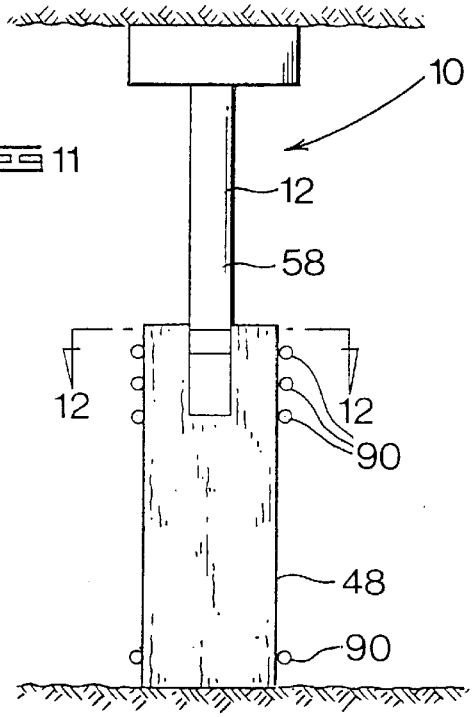
11
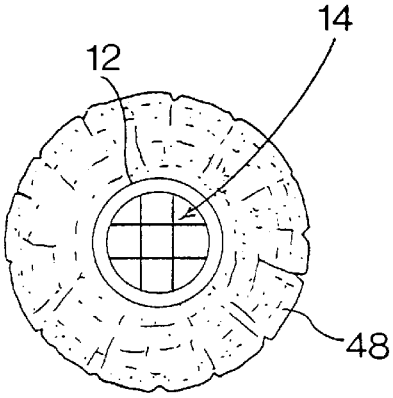
12

MINE PROPS

BACKGROUND OF THE INVENTION

THIS invention relates to mine props.

Timber-based mine props are used widely in underground mine workings to provide yielding support for the hanging wall. In most South African gold mining applications, it is required that props be capable of providing adequate hanging wall support while safely accommodating closure of 200 mm to 300 mm of the hanging wall. In such applications, once the hanging wall has closed by 200 mm to 300 mm, work in the mine working has generally advanced some distance or to another location altogether. Typical examples of known props which satisfy these criteria are those props sold under the trade marks PROFILE PROP and WEDGE PROP.

In some cases there may, however, be a requirement for props to accommodate greater hanging, wall closures, possibly of 400 mm or even more, while supporting the required load. It is believed that the known props, while performing well at lower stope closures, are unsuitable to accommodate closures of this magnitude.

SUMMARY OF THE INVENTION

According to one aspect of the present invention there is provided a mine prop comprising a cutting device and a cuttable plunger, the cutting device including a sleeve having first and second ends and cutting means which is fixed to the sleeve and which presents cutting edges transverse to the sleeve axis and a plurality of axially oriented openings between the cutting edges, and a vacant space defined in the sleeve on that side of the cutting means towards the second end of the sleeve, the cuttable plunger projecting from the first end of the sleeve with at least a portion of the plunger extending within the sleeve to the cutting means, the arrangement being such that when compressive loading applied to the mine prop is of sufficient magnitude to cause the cutting device and plunger to telescope together, the cutting edges of the cutting means cut axially through the cuttable plunger and the resulting segments of the plunger pass through the openings into the vacant space where they are restrained within the sleeve.

In the preferred embodiments of the invention, the cutting means is fixed inside the sleeve and forms, with the first end of the sleeve, a first socket in which at least a portion of an end of the plunger is received. The end of the plunger may be entirely received within the first socket.

In some embodiments, there is a second socket at the second end of the sleeve, the second socket receiving a load bearing member which projects from the second end of the sleeve and the vacant space being defined in the sleeve between the cutting means and the second socket.

The second socket may, for instance, be formed by a plate spaced away from the second end of the sleeve and spanning across the interior of the sleeve and the load bearing member may be a length of timber.

The invention also includes embodiments having a second cutting means fixed inside the sleeve and forming, with the second end of the sleeve, a second socket in which a second cuttable plunger is received, the vacant space being defined between the first and second cutting means.

Conveniently, the cutting means comprises a plurality of angle section members fixed to one another and to the sleeve. The arrangement may be such as to form a central opening and a plurality of peripheral openings.

According to another aspect of the invention there is provided a mine support comprising the combination of the mine prop summarised above and a preload unit operable to place the prop under an axial preload force between a hanging wall and a footwall of a mine working. The preload unit can be fixed to the sleeve of the cutting device of the prop.

BRIEF DESCRIPTION OF THE DRAWINGS

The invention will now be described in more detail, by way of example only, with reference to the accompanying drawings in which:

FIG. 1 shows a perspective view of a mine prop cutting device;

FIG. 2 shows a side view of the cutting device of FIG. 1;

FIG. 3 shows a cross-section at the line 3—3 in FIG. 2;

FIG. 4 shows a vertical cross-section through an installed mine prop according to a first embodiment of the invention, prior to application of compressive load thereto;

FIG. 5 shows a vertical cross-section similar to that of FIG. 4 after closure of the hanging wall has taken place;

FIG. 6 shows a side view of a mine prop cutting device according to a second embodiment of the invention;

FIG. 7 shows a cross-section, similar to that of FIG. 5, illustrating the operation of the second device;

FIG. 8 is a graph illustrating the performance of a prop according to the first embodiment of the invention;

FIG. 9 shows a cross-sectional view of a mine prop according to a third embodiment of the invention;

FIG. 10 shows a cross-section at the line 10—10 in FIG. 9;

FIG. 11 shows a cross-sectional view of a mine prop according to a fourth embodiment of the invention; and FIG. 12 shows a cross-section at the line 12—12 in FIG. 11.

DESCRIPTION OF PREFERRED EMBODIMENTS

FIGS. 1 to 3 illustrate a mine prop cutting device 10 according to a first embodiment of the invention. The cutting device 10 includes a round cylindrical steel sleeve 12, a cutter 14 located in the sleeve towards a first end 16 thereof and a restraining means 18 located in the sleeve towards the opposite, second end 20 thereof.

The nature of the cutter 14 will be particularly apparent from FIG. 3. As shown in this FIGURE, the cutter includes five identical, short lengths of angle section steel 22 which have the ends of their legs welded at 24 to the internal surface of the sleeve 12. In a typical case, the members 22 are provided by approximately 75 mm lengths of standard 70mm×70 mm×6 mm angle section steel.

The cutter also includes five identical, short lengths of angle section steel 26 which have the ends of their legs welded at 28 to the legs 30 of the angle section steel members 22. It will be noted that the assembly of angle section steel members 22 and 26 form a series of axially extending openings 32 adjacent the sleeve and a central, star-shaped axially extending opening 34. In the typical case, the members 26 are approximately 75 mm lengths of standard 40 mm×40 mm×3 mm angle section steel.

It is to be noted that the ends of the respective members 22 and 26 are cut off square, i.e. they are not sharpened in any way. It is also to be noted that, while FIG. 3 illustrates one possible form of cutter many other forms are within the scope of the invention, the only criterion that the cutter be capable of being forced axially, i.e. of cutting through, a length of timber, typically of the Saligna variety, when sufficient axial load is applied thereto.

The restraining means 18 is provided by a circular steel plate 36 welded at its periphery 38 to the internal surface of the sleeve 12.

FIG. 4 illustrates a prop 40, according to the invention, installed in a load bearing condition between the footwall 42 and the hanging wall 44 of a mine working 46. The prop 40 includes, in addition to the cutting device 10 described above, a timber plunger 48 and a timber load bearing member 50.

The timber plunger 48 is a length of round cross-section timber, typically of the Saligna variety, with an outside diameter closely matched to the inside diameter of the sleeve 12. The upper end of the plunger 48 is inserted into the operatively lower end 16 of the sleeve so as to bear against the cutter 14.

The load bearing member 50 is also in the form of a round cross-section timber, once again typically of the Saligna variety. In this case, the lower end of the member 50 is inserted into the operatively upper end 20 of the sleeve and bears against the steel plate 36. Both the plunger 48 and member 50 are snug fits in the respective ends of the sleeve 12.

The prop 40 forms part of a mine support indicated generally with the numeral 52. In addition to the prop 40, the mine support 52 includes a preload device indicated diagrammatically by the numeral 54. This preload device may, for instance, be a hydraulically operated preload unit such as that described in South African patent 95/9113, the disclosure of which is incorporated herein. Alternatively, it may include a headboard and a preload bag which is placed on top of the headboard and which is charged with a settable grout. In the latter case, the preload device may, for instance, be of the type described in any one of South African patents 91/4190, 92/9685, 93/1433 and 94/7397, the disclosures of which are also incorporated herein. The present invention is not directly concerned with the nature of the preload device which may, in fact, have any appropriate design capable of applying an axial preload force of predetermined magnitude to the prop 40. It will be appreciated that in each case, the preload device serves to apply a predetermined preload force to the installed prop 40.

In some applications of the present invention, there may be no preload device at all. In such cases, the prop 40 is merely wedged in position between the footwall and hanging wall. However some form of preload device will generally be preferred, since the action of a preload device will immediately place the prop 40 in a condition to accept applied axial loading from the hanging wall 44.

FIG. 4 shows the prop 40 in an initially installed, preloaded condition. FIG. 5 shows the same prop after some convergence between the hanging wall 44 and the footwall 42 has taken place. When the compressive loading applied to the mine support 52 exceeds a critical value the cutter 14 in the sleeve 12 begins to cut axially into and through the timber of the plunger 48.

Although relatively blunt, the lower edges of the angle section members 22 and 26 perform a cutting action as they force their way through the timber. The timber is accordingly cut into a series of segments or portions, indicated with the numeral 56, having cross-sectional shapes corresponding to the shapes of the axially extending openings 32 and 34 of the cutter.

The compressive resistance provided by the prop. i.e. its load bearing capacity, is determined by the axial force required to drive the cutter 14 through the timber of the plunger 48. It will be appreciated that the compressive resistance can be varied by varying the design of the cutter. Thus by appropriately selecting the cutting ability of the cutter 14 it is possible to select the load at which the prop will yield, i.e. the load which the prop can support while yielding axially in length.

The cut segments or portions 56 are restrained and eventually compressed within the space 58 which exists in the sleeve 12 between the cutter 14 and the plate 36. It is believed that this feature is extremely important, since it prevents uncontrolled movement of the cut portions of the timber. The controlled restraint of the cut portions of the timber distinguish the present invention from prior proposals in which cutters of one type or another are caused to cut axially into and through a length of timber.

In all previously proposed designs cut portions of the timber are allowed to disperse freely and in an uncontrolled manner, leading inevitably to an absence of consistency in the load bearing capabilities of the prop.

FIG. 6 shows a modified cutting device according to the invention. In this case, the steel plate 36 forming the restraining member 18 is replaced by another cutter 60, identical in all respects to the cutter 14. Referring to FIG. 7 it will be seen that in operation of the embodiment of FIG. 6, the upper cutter 60 is caused, by the applied compressive loading, to cut upwardly into and through the timber of the load bearing member 50 which acts, in this case, as a plunger in much the same way as the plunger 48. The cut portions 62 of timber from the member 50 enter the space 58 in the same way as the cut portions 56 from the plunger 48. Thus it will be appreciated that in this embodiment, there will generally be simultaneous cutting of both the upper and lower timber members 50 and 48. given the natural inconsistencies of timber, it may of course happen that one or other of the timber members is cut preferentially. Irrespective of whether both or only one timber member is cut by the cutters 14 and 60, the cut portions will enter and be restrained in a controlled manner within the space 58 in the sleeve 12.

FIG. 8 is a graph illustrating the performance of a prop of the type indicated by the numeral 40 in FIG. 4. The prop 40 was installed upright between the platens of an hydraulic press and the spacing between the platens was decreased at a constant speed of 30 mm/min, thereby simulating, albeit at a greatly increased rate, the closure of the hanging wall relative to the footwall in a mine working.

In the test represented by the graph, the overall length of the prop 40 was 1,5 m and the diameters of the plunger 48 and member 50, of Saligna timber, were 209 mm. No preload was applied to the test prop which was merely wedged between the platens of the press at the outset.

In the graph, the applied compressive load is indicated on the vertical axis and the deformation, i.e. closure, on the horizontal axis. It will be noted that in the region marked "A" of the graph, the prop rapidly picked up load, Thereafter, in the region "B", the prop continued to pick up load gradually until a closure of approximately 250 mm had been obtained under a load of about 350 kN. At the point "C", the previously smooth nature of the graph was interrupted and in the region "D", although the prop continued to support a substantial and in fact gradually increasing load, the earlier consistency was largely absent. Nevertheless it will be appreciated that under test conditions, the prototype prop performed extremely well and, overall, with reasonable consistency.

Although not fully understood, it is believed that the ability of the prop to take a gradually increasing load is attributable to increasing friction between timber fibers within the sleeve as the cutting action of the cutter 14 proceeds.

Although also not fully understood, it is believed that the slight inconsistency in performance in the region "D" of the graph is attributable to some breakage taking place in the timber fibers at least in the timber plunger 48.

An important feature illustrated by the graph of FIG. 8 is the fact that the prop was able to support a considerable load over a closure in excess of 400 mm. It is believed that by varying the axial length of the space 58 inside the sleeve it will be possible to accommodate virtually any desired closure within reasonable limits.

The invention also contemplates another version of the invention in which the sleeve of the cutting device is not in form of a continuously cylindrical member, but rather in the form of a cage of steel members defining a cylindrical cavity. However it is anticipated that this type of configuration will not operate as well as the versions described above because of the reduction in controlled restraint of the cut timber portions which can be expected.

In yet another version contemplated by the invention, the lengths of angle section 26 are replaced by lengths of steel tube oriented with their axes vertical. The effect, once again, is to produce a series of axially extending openings through which portions of the timber will pass as the cutter moves axially through the timber plunger and/or load bearing member.

FIG. 9 illustrates a third embodiment of the invention. In this case, the cutting device 10 has the cross-sectional configuration seen in FIG. 10. The cutter 14 of this device consists of seven angle section steel members 70 which are welded to the sleeve 12 at points 72 and to one another at points 74, thereby defining outer and inner axially extending openings 74, 76 corresponding to the openings 32, 34 of the first embodiment described above.

Referring to FIG. 9, the numeral 54 once again indicates a preload device. This device 54 is shown as a hydraulic, MADODA (trade mark)—type preload unit of the type described in the specification of South African patent 95/9113. It comprises a tube 76 with a counter-member 78 spanning across the tube at one end. In this case, the tube and counter-member are formed in one piece and define a pot. A cup-shaped member 80 is fixed inside the pot by means of a peripheral weld 82. A valved inlet 84 leads into the pot and communicates with the space between the bases of the pot and of the cup-shaped member. The socket defined by the tube 76 and cup-shaped member 80 accommodates a load bearing member 86 in the form of a length of timber which is a snug fit in the socket. The preload unit 54 is welded at 88 to the upper end of the cutting device 10.

FIG. 9 illustrates the assembled mine support and shows that the upper end of the preload unit 54 is arranged adjacent the hanging wall 44. When the preload unit 54 is pressurised with hydraulic fluid, typically water, through the inlet 84, the water pressure everts the cup-shaped member and telescopes the timber load bearing member 86 upwardly against the hanging wall, thereby placing the prop 40 under axial preload.

As in the previous embodiments, the upper end of the timber plunger 48 in FIG. 9 is received in the lower end of the sleeve 12. In practice, the cutting device 10 is initially anchored to the timber plunger by pressing the timber plunger, in the factory, at least partially through the cutter 14.

When convergence takes place between the hanging wall and footwall, the cutter 14 is pressed progressively further through the timber of the plunger 48.

The timber portions formed by the cutter extend into the restraining space inside the sleeve between the cutter and the preload device 54 and are eventually compressed in that space, as before.

FIG. 11 illustrates a fourth embodiment of the invention. The major difference between this embodiment and the earlier embodiments is the fact that the diameter of the sleeve 12 is somewhat less than that of the timber plunger 48. The lower end of the sleeve 12 is pressed, in the factory, into the end of the timber plunger so that the upper end of the timber plunger extends at least partially through the cutter 14. This effectively anchors the cutting device and timber plunger to one another and prevents them from being separated during transportation.

FIG. 12 shows the cross-sectional configuration of the cutting device used in the FIG. 11 embodiment. In this case the cutter 14 consists of a series of flat bars welded to one another to form the illustrated configuration which, once again, defines a series of axially extending openings.

With the configuration illustrated in FIG. 11, it will be appreciated that as yielding progresses, the cutter 14 only cuts through a central core region of the timber plunger. As before, the timber portions formed by the action of the cutter enter the space 58 and are restrained therein. The timber plunger 48 is encircled by a series of wire hoops 90 which restrain outward expansion of the timber as the cutting device moves axially through the timber of the plunger.

An advantage of the FIG. 11 embodiment over the earlier embodiments is the fact that smaller diameter, and hence less expensive, sleeve 12 is employed. It will also be understood that the lower edge of the sleeve 12 itself performs a cutting action as it is pressed downwardly relative to the timber plunger. Thus in this case extra yielding resistance is provided by the sleeve itself. A further advantage of this embodiment arises from the fact that it is not necessary to turn the timber plunger 48 to an accurate diameter.

We claim:

1. A mine prop comprising a cutting device and a cuttable plunger, the cutting device including a sleeve having first and second ends and cutting means which is fixed to the sleeve and which presents cutting edges transverse to the sleeve axis and a plurality of axially oriented openings between the cutting edges, and a vacant space defined in the sleeve on that side of the cutting means towards the second end of the sleeve, the cuttable plunger projecting from the first end of the sleeve with at least a portion of the plunger extending within the sleeve to the cutting means, wherein when compressive loading applied to the mine prop is of sufficient magnitude to cause the cutting device and plunger to telescope together, the cutting edges of the cutting means cut axially through the cuttable plunger to form a plurality of plunger segments which pass through the openings into the vacant space where they are restrained within the sleeve.

2. A mine prop according to claim 1 wherein the cutting means is fixed inside the sleeve and forms, with the first end of the sleeve, a first socket in which at least a portion of an end of the plunger is received.

3. A mine prop according to claim 2 wherein the end of the plunger is entirely received within the first socket.

4. A mine prop according to either claim 3 comprising a second socket at the second end of the sleeve, the second socket receiving a load bearing member which projects from the second end of the sleeve and the vacant space being defined in the sleeve between the cutting means and the second socket.

5. A mine prop according to claim 4 wherein the second socket is formed by a plate spaced away from the second end of the sleeve and spanning across the interior of the sleeve.

6. A mine prop according to claim 5 wherein the load bearing member is a length of timber.

7. A mine prop according to claim 2 wherein the sleeve and plunger are round in cross-section, the sleeve has a smaller diameter than the plunger, and only a central portion of the plunger is received in the first socket.

8. A mine prop according to claim 3 comprising a second cutting means fixed inside the sleeve and forming, with the second end of the sleeve, a second socket in which a second cuttable plunger is received, the vacant space being defined between the first and second cutting means.

9. A mine prop according to claim 8 wherein the cutting means comprises a plurality of angle section members fixed to one another and to the sleeve.

10. A mine prop according to claim 9 wherein the angle section members define a central opening and a plurality of peripheral openings.

11. A mine prop according to claim 1 wherein the plunger is of timber.

12. A mine support which includes:

a mine prop comprising a cutting device and a cuttable plunger, the cutting device including a sleeve having first and second ends and cutting means which is fixed to the sleeve and which presents cutting edges transverse to the sleeve axis and a plurality of axially oriented openings between the cutting edges, and a vacant space defined in the sleeve on that side of the cutting means towards the second end of the sleeve, the cuttable plunger projecting from the first end of the sleeve with at least a portion of the plunger extending within the sleeve to the cutting means, wherein when compressive loading applied to the mine prop is of sufficient magnitude to cause the cutting device and plunger to telescope together, the cutting edges of the cutting means cut axially through the cuttable plunger to form a plurality of plunger segments which pass through the openings into the vacant space where they are restrained within the sleeve; and a preload unit operable to place the mine prop under an axial preload force between a hanging wall and a footwall of a mine working.

13. A mine supporting according to claim 12 wherein the pre load unit is fixed to the sleeve of the cutting device of the mine prop.

* * * * *